United States Patent [19]

Carpenter

[11] Patent Number: 4,884,730

[45] Date of Patent: Dec. 5, 1989

[54] CANE GUARD

[76] Inventor: Conrad L. Carpenter, 37 Hobe Sound MHP, Hobe Sound, Fla. 33455

[21] Appl. No.: 345,423

[22] Filed: May 1, 1989

Related U.S. Application Data

[63] Continuation-in-part of Ser. No. 60,410, Jan. 5, 1987, abandoned.

[51] Int. Cl.[4] ..... B65H 75/40

[52] U.S. Cl. ..... 224/162; 224/251; 224/200; 224/250; 224/901; 135/66

[58] Field of Search ..... 224/251, 901, 162, 269, 224/200, 904, 250, 914; 135/65, 66, 71

[56] References Cited

U.S. PATENT DOCUMENTS

| | | | |
|---|---|---|---|
| 484,335 | 10/1892 | Moss | 224/251 |
| 520,135 | 5/1894 | Comins | 224/200 |
| 781,629 | 2/1905 | Ahlstrom | 224/269 |
| 1,120,092 | 12/1914 | Seeber | 135/66 |
| 1,262,005 | 4/1918 | Bell | 224/162 |
| 1,758,379 | 5/1930 | Shaw | 135/66 |
| 3,307,754 | 3/1967 | Anketell | 224/251 |
| 3,970,228 | 7/1976 | Keller | 224/251 |
| 4,020,985 | 5/1977 | Halterman | 224/251 |
| 4,220,302 | 9/1980 | Hampton et al. | 224/901 |
| 4,424,923 | 1/1984 | Bingham | 224/251 |
| 4,498,613 | 2/1985 | Donahue et al. | 224/251 |

*Primary Examiner*—Linda J. Sholl
*Attorney, Agent, or Firm*—Alvin S. Blum

[57] ABSTRACT

A walking cane is yieldably attached to a user so that it may be recovered without bending if dropped. The attachment does not interfere with ordinary use of the cane in walking. A spring-loaded retractable chain in a reel attaches removably to the user's belt. The free end of the chain holds an "S" hook. The hook attaches to a grommet on a strap that encircles the cane and fastens adjustably about the cane with a hook and loop type fastener. A rubber "O" ring slides over the cane to snugly engage the cane above the strap. The "O" ring prevents the strap from riding up the cane during use of the device.

4 Claims, 1 Drawing Sheet

CANE GUARD

This application is a continuation-in-part of copending application Ser. No. 060,410 filed 1/5/87, hereby abandoned.

BACKGROUND OF THE INVENTION

Many individuals who require the help of a cane when walking do not have the ability to recover a cane when it is accidentally dropped or misplaced. They may be lacking in agility or vision or both. To assist those individuals, it would be useful to provide a means for recovering the dropped or misplaced cane that would not interfere with use of the cane and that would not be displaced by the motions involved in walking with a cane and that is easily applied without special skills or tools.

SUMMARY OF THE INVENTION

It is accordingly an object of the invention to provide a means, easily attachable to the cane and to the user of the cane that will enable the user to retrieve the cane if accidentally misplaced or dropped. It is yet another object of the invention to provide such a device that is readily applied by the user without special skills or tools and without modification of the cane or walking stick. Furthermore the invention should allow the user to release the cane to use both hands for another task without fear of losing control of the cane or walking stick.

The invention comprises a strap having a hook and loop fastener for securely encircling the elongate shaft of the cane, and a second strap connected to the first strap at right angles and having a connection for engaging the free end of a spring-loaded chain held in a reel that fastens to the user's belt. A snug-fitting rubbery O-ring fits over the cane shaft and engages the upper end of the strap encircling the shaft. This O-ring prevents the strap from sliding up the shaft from repeated tugs as the user swings the cane in walking. It is simple and effective and doesn't require permanent modification of the cane.

These and other objects, advantages and features of the invention will be understood more fully from consideration of the following detailed description and accompanying drawings.

DETAILED DESCRIPTION OF THE PREFERRED EMBODIMENT

Figures 1, 2:
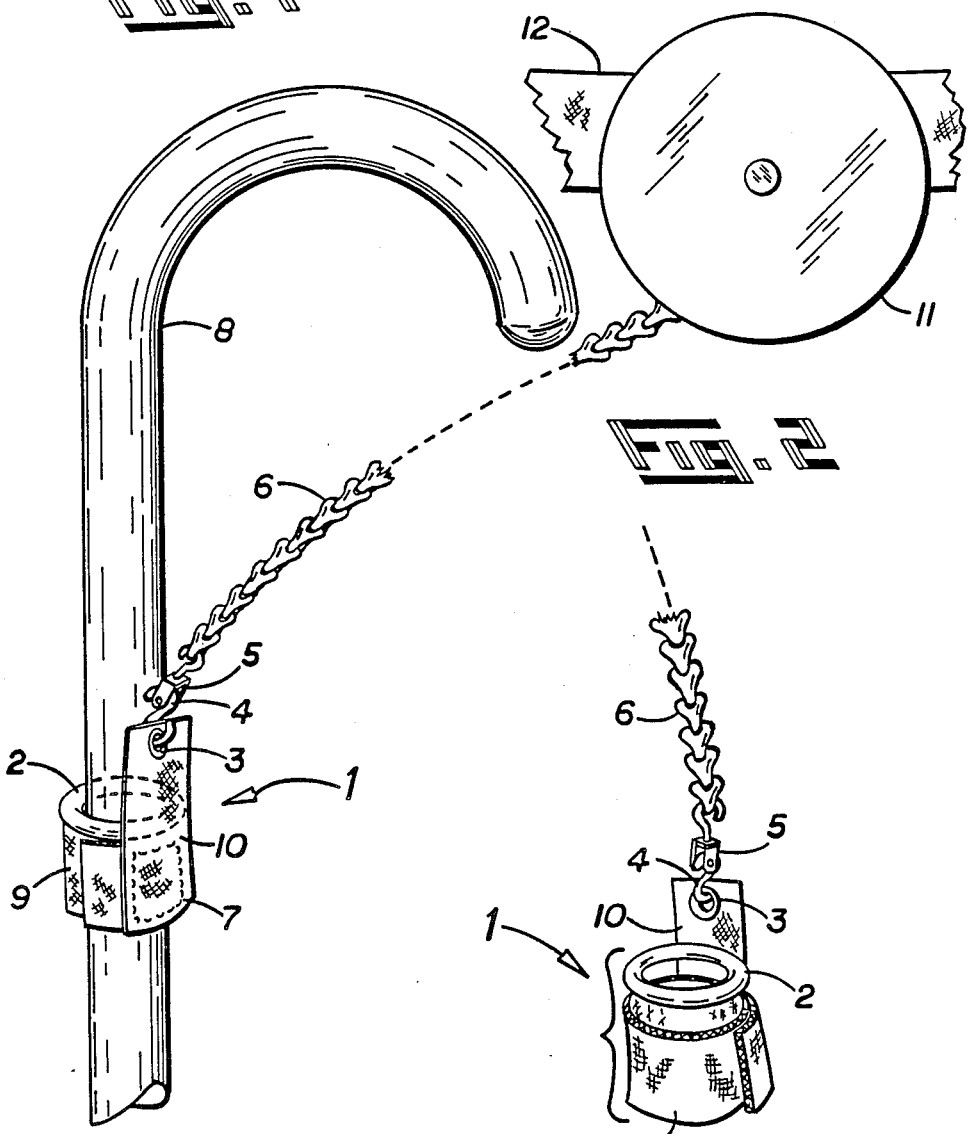
FIG. 1 shows a perspective view of the invention in place on a cane attached to the end of a retractable chain on a belt.
FIG. 2 is a perspective view of the device of FIG. 1 seen from the reverse side.

Referring now to FIGS. 1 and 2, the device of the invention, indicated generally by the reference number 1 includes a shaft strap 7 having hook-and-loop fastening means 9 affixed thereto and arranged so that the strap may be wrapped around the straight shaft of the walking stick or cane 8 and the ends joined together by the hook-and-loop fastening means. A perpendicular strap 10 is sewn securely to the shaft strap 7. Perpendicular strap 10 has a metal grommet 3 installed at its free end. An "S" hook 4 removably connects the strap 10 and its attachments to a swivel 5 which is attached to a spring-loaded retractable chain 6. The chain 6 retracts into reel 11 that removably fastens to a belt 12 to be worn about the waist of the user. An elastomeric "O" ring 2 slides up onto the shaft of cane 8 and the shaft strap 7 is secured about the shaft so that its upper end engages the lower edge of the "O" ring 2. The "O" ring prevents the strap 7 from sliding up the shaft of the cane from the repeated pulling or tugging forces transmitted through chain 6 as the cane is swung forward with every step taken by the user.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. In combination with a walking cane having a generally straight elongate portion connected to a handle portion, an attachment device for holding said cane to a belt encircling a user of said cane wherein said device does not interfere with use of said cane and provides convenient means to retrieve said cane when dropped, said attachment device comprising:

(a) a spring-loaded reel including a retractable chain having a free end;

(b) a reel casing encasing said reel and having belt attaching means for attaching to said belt of said user;

(c) an elongate strap means having a long dimension great enough to encircle said straight elongate portion of said cane and having hook and loop fastening means for adjustably and releasably securing said strap means to said cane when so encircled;

(d) accessory strap means connected to said elongate strap means, said accessory strap means having a connector-engaging means therein for engaging a connector;

(e) a connector attached to said free end of said chain, said connector removably connected to said connector-engaging means;

(f) an elastomeric "O" ring having an inside diameter less than the circumference of said straight portion of said cane, said "O" ring fitting snugly on said cane above said elongate strap means and engaging the upper edge of said elongate strap means to prevent said strap means from moving up said cane during use of said cane.

2. The device according to claim 1, in which said connector and said connector-engaging means include an "S" hook and a grommet, respectively.

3. In combination with a walking cane having a generally straight elongate portion connected to a handle portion, an attachment device for holding said cane to a belt encircling a user of said cane by means of a belt-attached, spring-loaded reel with a retractable chain having a free end, wherein said device does not interfere with use of said cane and provides convenient means to retrieve said cane when dropped, said attachment device comprising:

(a) an elongate strap means having a long dimension great enough to encircle said straight elongate portion of said cane and having hook and loop fastening means for adjustably and releasably securing said strap means to said cane when so encircled;

(b) accessory strap means connected to said elongate strap means, said accessory strap means having a connector-engaging means therein for engaging a connector;

(c) an elastomeric "O" ring having an inside diameter less than the circumference of said straight portion of said cane, said "O" ring fitting snugly on said cane above said elongate strap means and engaging the upper edge of said elongate strap means to prevent said strap means from moving up said cane during use of said cane.

4. The device according to claim 3, in which said connector-engaging means includes a grommet.

* * * * *